US010881978B2

(12) United States Patent
Miller

(10) Patent No.: US 10,881,978 B2
(45) Date of Patent: Jan. 5, 2021

(54) ERGONOMIC FLYING DISC

(71) Applicant: William Wheelwright Miller, Greenfield, MA (US)

(72) Inventor: William Wheelwright Miller, Greenfield, MA (US)

( * ) Notice: Subject to any disclaimer, the term of this patent is extended or adjusted under 35 U.S.C. 154(b) by 255 days.

(21) Appl. No.: 16/025,445

(22) Filed: Jul. 2, 2018

(65) Prior Publication Data

US 2019/0001236 A1 Jan. 3, 2019

Related U.S. Application Data

(60) Provisional application No. 62/527,678, filed on Jun. 30, 2017.

(51) Int. Cl.
*A63H 33/18* (2006.01)

(52) U.S. Cl.
CPC ..... *A63H 33/18* (2013.01)

(58) Field of Classification Search
CPC ..... A63H 33/18
See application file for complete search history.

(56) References Cited

U.S. PATENT DOCUMENTS 3,359,678 A 12/1967 Headrick
4,334,385 A * 6/1982 Melin ..... A63H 33/18 446/46
4,820,230 A * 4/1989 Richards ..... A63B 67/06 446/46
5,531,624 A * 7/1996 Dunipace ..... A63B 65/10 446/46
6,179,737 B1 * 1/2001 Adler ..... A63B 65/10 446/46
9,731,216 B2 * 8/2017 Richardson ..... A63H 33/18
2004/0132561 A1 * 7/2004 McClung ..... A63H 33/18 473/465
2005/0197037 A1 * 9/2005 Potts ..... A63H 33/18 446/46
2010/0279579 A1 * 11/2010 Michelsen ..... A63H 33/18 446/46

FOREIGN PATENT DOCUMENTS

WO WO-9803239 A1 * 1/1998 ..... A63H 33/18

OTHER PUBLICATIONS

Article titled "Shore Hardness and Soft TPEs" by Elizabeth Ponte and published on Sep. 20, 2017.*
M Licata, Disc Technical Standard, Feb. 26, 2015, PDF document, p. 1, published by USA Ultimate 5825 Delmonico Dr. Suite 350 Colorado Springs, CO 80919.

* cited by examiner

*Primary Examiner* — Blake A Tankersley

(57) ABSTRACT

A flying disc is disclosed. The flying disc can conform with a disc standard set forth by USA Ultimate. The flying disc can include a first portion that comprises a first material and a second portion that comprises a second material. The first portion has a first thickness from a top surface to a bottom surface. The second portion has a second thickness from an outer edge to an inner edge. The first material has Shore Scale greater than the second material. The second thickness is greater than the first thickness.

6 Claims, 6 Drawing Sheets

ERGONOMIC FLYING DISC

CROSS-REFERENCE TO RELATED APPLICATIONS

This application claims priority to U.S. Provisional Patent Application No. 62/527,678, filed Jun. 30, 2017, the entire contents of each of which are hereby incorporated by reference herein in their entirety and for all purposes.

BACKGROUND

Field of the Invention

The field relates generally to flying discs, and in particular, to ergonomic flying discs for use in the sport of Ultimate.

Description of the Related Art

The sport of Ultimate, also known as Ultimate Frisbee®, has grown rapidly since its development in the late 1960s, with estimates of more than 5 million athletes playing the sport in the US as of 2012. Ultimate is a team sport played with a flying disc that is designed to be thrown and caught using a variety of techniques. Conventional flying discs used in the sport of Ultimate are typically single-injection molded polyethylene discs having a mass of approximately 175 g and a diameter of approximately 274 mm. A rim portion of a conventional disc is approximately 7.5 mm in thickness measured from an outer surface to an inner surface, and may be gripped in most throwing and catching techniques. However, throwing and catching the flying disc may be challenging and in come cases, may cause injuries in doing so.

SUMMARY

In one aspect, a flying disc is disclosed. The flying disc can conform with a disc standard set forth by USA Ultimate. The flying disc includes a first portion that comprises a first material and a second portion that comprises a second material. The first portion has a first thickness from a top surface to a bottom surface. The second portion has a second thickness from an outer edge to an inner edge. The first material has Shore Scale greater than the second material. The second thickness is greater than the first thickness.

In one embodiment, the second thickness is at least 10 times greater than the first thickness.

In one embodiment, the first thickness is at least 1.2 mm and less than 3 mm and the second thickness is at least 12 mm and less than 35 mm.

In one embodiment, the first material has Shore Scale that is at least 30 units greater than that of the second material.

In one embodiment, the first material has Shore Scale of at least about 40 Shore D and the second material has Shore Scale of at least about 30 Shore A.

In one embodiment, the first and second portions are permanently bonded during the injection molding process.

In one embodiment, the first material comprises polyethylene and the second material comprises elastomer foam.

In one aspect, a flying disc is disclosed. The flying disc is configured to be used in Ultimate flying disc. The flying disc includes a central portion comprising a first material and a rim portion comprising a second material. The central portion has a first thickness from a top surface to a bottom surface. The rim has a second thickness from an outer edge to an inner edge. The first material has Shore Scale hardness greater than the second material and the second thickness is greater than the first thickness.

In one embodiment, the second thickness is at least 10 times greater than the first thickness.

In one embodiment, the first thickness is at least 1.2 mm and less than 3 mm and the second thickness is at least 12 mm and less than 35 mm.

In one embodiment, the first material has Shore Scale that is at least 30 units greater than that of the second material.

In one embodiment, the first material has Shore Scale of at least about 40 Shore D and the second material has Shore Scale of at least about 30 Shore A.

In one embodiment, the central portion and the rim portion are permanently bonded during the injection molding process.

In one aspect, a flying disc is disclosed. The flying disc is configured to be thrown and caught by a human hand. The flying disc includes a central portion that comprises a first material and a rim portion that comprises a second material. The central portion has a first thickness from a top surface to a bottom surface. The rim portion having a second thickness from an outer edge to an inner edge. The first material has Shore Scale greater than the second material and the second thickness is greater than the first thickness.

In one embodiment, the second thickness is at least 10 times greater than the first thickness.

In one embodiment, the first thickness is at least 1.2 mm and less than 3 mm and the second thickness is at least 12 mm and less than 35 mm.

In one embodiment, the first material has Shore Scale that is at least 30 units greater than that of the second material.

In one embodiment, the first material has Shore Scale of at least about 40 Shore D and the second material has Shore Scale of at least about 30 Shore A.

In one embodiment, the first and second portions are permanently bonded during the injection molding process.

In one embodiment, the first portion comprises a bonding feature that contacts the second portion.

BRIEF DESCRIPTION OF THE DRAWINGS

These aspects and others will be apparent from the following description of preferred embodiments and the accompanying drawing, which is meant to illustrate and not to limit the invention, wherein.

DETAILED DESCRIPTION

Various embodiments disclosed herein relate to flying discs that are made of two distinct portions with different Shore Scales and/or two portions with different thicknesses. The two distinct portions may comprise two distinct materials, in some embodiments. The flying discs disclosed herein may be beneficial especially for throwing and catching techniques used in the sport of ultimate.

Problems with conventional disc designs can include, but are not limited to, a hardness of a material(s) used to define the disc causing minor injuries associated with catching the disc at high speed and/or with disc impacts to the face or other parts of a catcher's body, a relatively thin outer rim of the disc causing difficulty for new players learning common techniques used for throwing the disc, and/or properties of the material(s) used to define the disc causing the disc to warp when subjected to impact forces not uncommon in the sport a relatively thin outer rim limiting the maximum thrust applied to the disc in certain throwing techniques. Therefore, the embodiments disclosed herein can provide improved flying discs.

Various embodiments of a flying disc disclosed herein can include two portions, a first position (e.g., a central portion) and a second portion (e.g., a rim portion). In some embodiments, the two portion may comprise different materials. The two portions may have different Shore Scales. In some embodiments, the first portion may be harder than the second portion. In some embodiments, the second portion may be thicker than the first portion.

Figure 1:
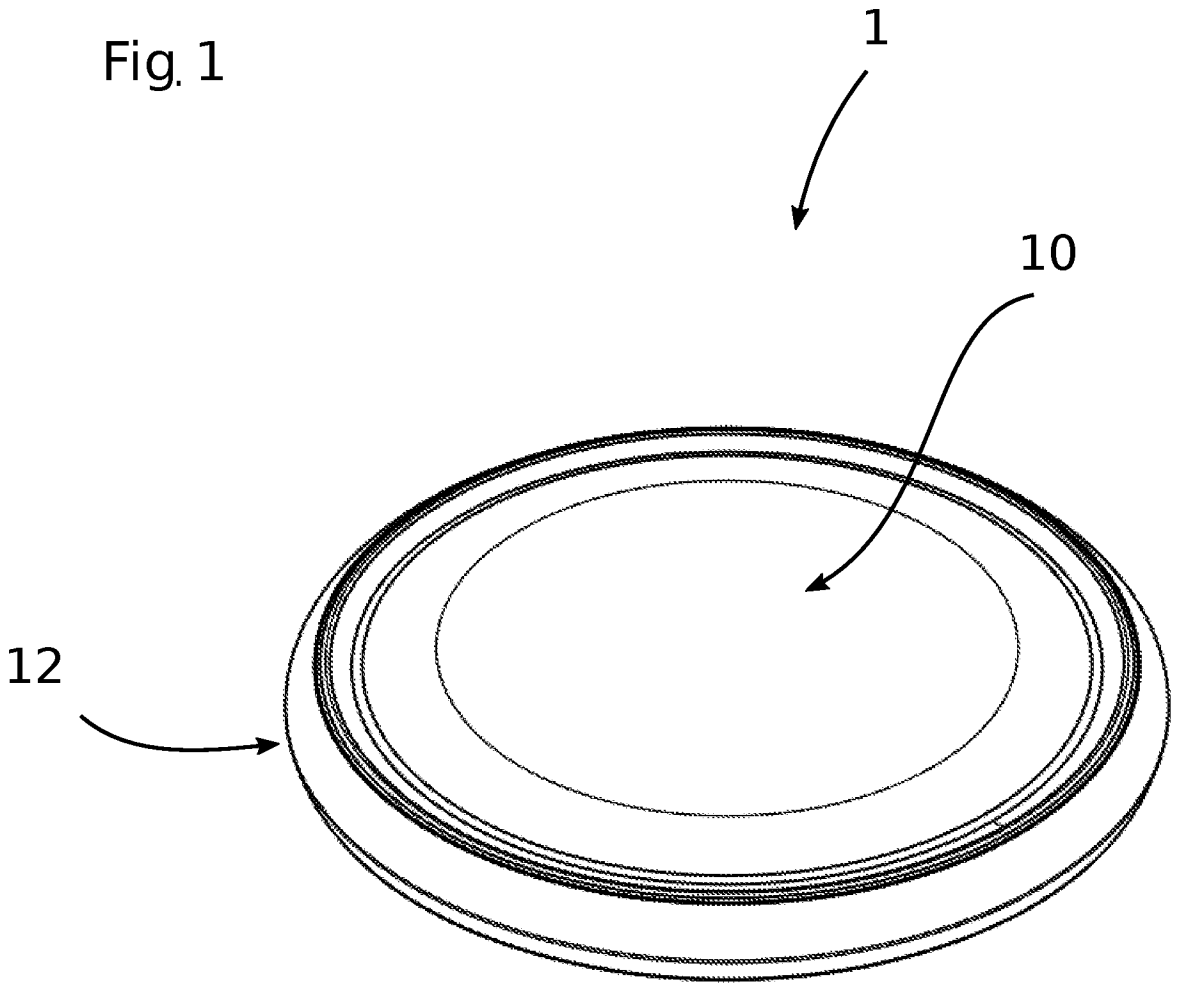
FIG. 1 is a schematic perspective view of a flying disc showing a top side of the disc, according to one embodiment.

FIG. 1 is a schematic perspective view of a flying disc 1, according to one embodiment. In some embodiments the disc 1 is configured to be used in Ultimate. The disc 1 comprises a first portion 10 (e.g., a central portion) and a second portion 12 (e.g., a rim portion). In some embodiments, the first portion 10 can comprise a first material and the second portion 12 can comprise a second material. In some other embodiments, the first and/or second portions may comprise any number of materials. In some embodiments, the first material and the second material may comprise different materials. For example, the first material may comprise polyethylene and the second material may comprise elastomer foam. For example, in some embodiments, the first and second materials may comprise polyethylene of different densities. In some embodiments, the first material and the second material can have a combined mass of about 175 g. In some embodiments, the combined mass can be in the range of, for example, 135 g to 210 g. In some embodiments, cavities or other features (e.g. trenches, openings, etc.) can be introduced in the second portion 12 in order to change a center of mass of the flying disc 1 and thus the stability of the flying disc 1. In some embodiments, the first material is harder than the second material. For example, the first material may have Shore Scale of about 70 Shore D and the second material may have Shore Scale of about 50 Shore A. In some embodiment, the first material has Shore Scale in a range of, for example, 40 D to 100 D, in a range of, for example, 50 D to 90 D, in a range of, for example, 70 D to 90 D, etc. In some embodiment, the second material has Shore Scale in a range of, for example, 10 A to 30 A, in a range of, for example, 30 A to 60 A, in a range of, for example, 60 A to 90 A, etc. In some embodiments, the first portion may comprise a generally flat shape. In some embodiments, the first portion 10 may comprise a generally flat portion and a curved portion. In some embodiments, the first portion 10 may have a curved edge creating a three dimensional revolved arch or a bowl like shape. In some embodiments, the first portion 10 and the second portion 12 may be bonded together in an injection molding process.

In use, a user may grip the second portion 12 to throw the disc. For example, in a backhand throwing technique, the user's thumb can apply gripping force to a portion of the top surface 18 while the user's fingers may wrap around at least a portion of the second portion 12 and apply gripping force to an inner portion of the disc 1. The user's palm can rest ergonomically upon an outer surface of the disc 1, which may partially conform to a part of the palm as a result of, for example, deformation of a relatively soft second material. A specific thickness of the second portion 12 can provide the user's hand with improved leverage and control relative to a conventional thickness, due to, for example, the achievement of relatively optimal sarcomere length of the user's upper limb musculature (e.g., forearm muscles, hand muscles, etc.) as the user's hand grips the specific thickness of the second portion 12. Said improved leverage may also increase a maximum thrust the user may impart to the disc 1 using certain throwing techniques. In some embodiments, the second portion 12 (e.g., the rim portion) may be, for example, about 22 mm in thickness to promote said leverage.

Figure 2:
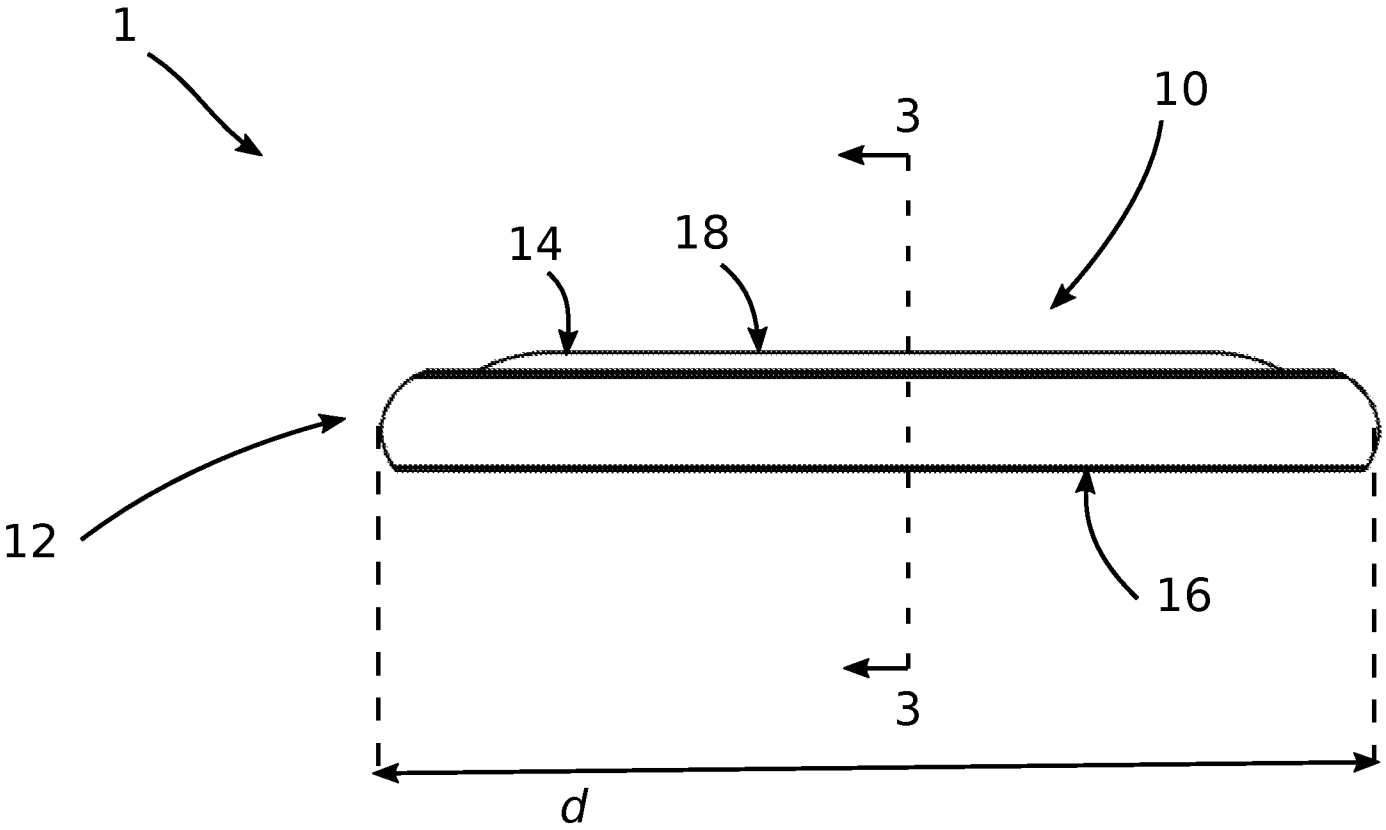
FIG. 2 is a schematic side view of the flying disc of FIG. 1.

FIG. 2 is a schematic side view of the flying disc 1 of FIG. 1. The flying disc 1 has a top side 14 and a bottom side 16. In some embodiments, the top side may comprise the top surface 18 of the first portion 10. The disc 1 has a diameter d from an outermost portion of the rim of the disc 1 to another outermost portion that passes through a center of the disc 1. The diameter d may be about 274 mm. The diameter d may be in a range of, for example, 250 mm to 290 mm, in a range of, for example, 265 mm to 280 mm, etc. In some embodiments, the diameter d can conform with a disc standard set forth by USA Ultimate. The disc 1 may also have a weight that conforms with the disc standard set forth by USA Ultimate. USA Ultimate is a non-profit organization that serves as a governing body of the sport of Ultimate.

Figure 3:
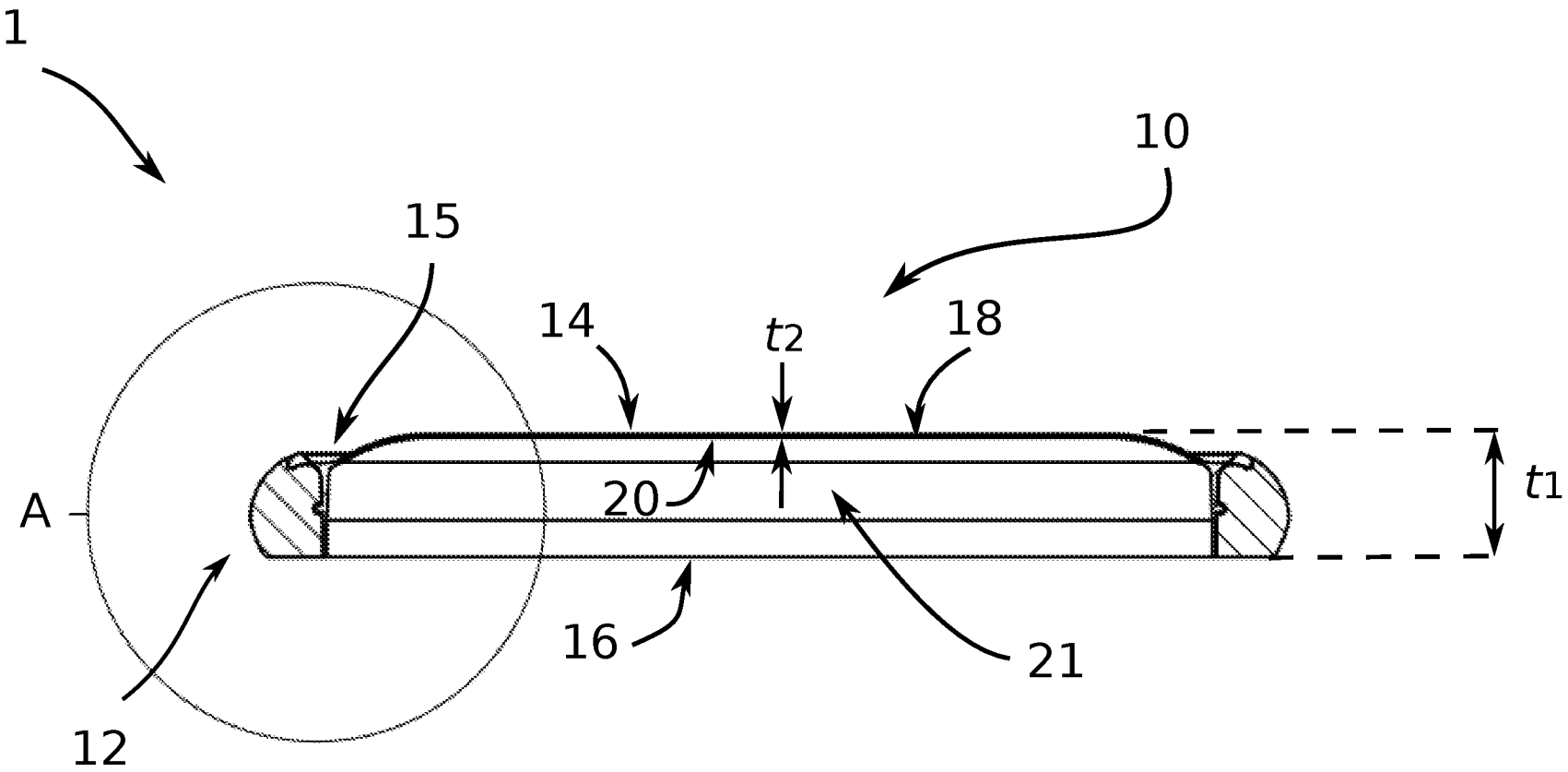
FIG. 3 is a schematic cross sectional view of the flying disc of FIGS. 1 and 2, taken through a center of the disc and perpendicular to a top surface.

FIG. 3 is a schematic cross sectional view of the flying disc 1 of FIGS. 1 and 2, taken through a center of the disc 1 and perpendicular to the top surface 18. The first portion 10 of the disc 1 has a top surface 18 and a bottom surface 20 opposite the top surface 18. As illustrated in FIG. 3, the first portion 10 and the second portion 12 may collectively define an opening 21. In some embodiments, the first portion 10 may define an inner surface of the opening 21 as illustrated in FIG. 3. However, in some embodiments, the second portion 12 may extend through the first portion 10 such that the first and second portions 10, 12 define the inner surface of the opening 21. In some embodiments, an outer surface of the disc 1 may be defined by the first and second materials. In some embodiments, the outer surface of the disc 1 may be defined by the first material and the inner surface may be defined by the first and second materials.

The disc 1 has a disc thickness t1 measured from the top side 14 of the disc 1 to the bottom side 16 of the disc 1. The disc thickness t1 can be, for example, about 32 mm. The disc thickness t1 can be in a range of, for example, 27 mm to 37 mm, in a range of, for example, 30 mm to 34 mm, etc. In some embodiments, the disc thickness t1 can conform with the disc standard set forth by USA Ultimate.

The first portion 10 has a central portion thickness t2 measured from the top surface 18 of the first portion 10 to the bottom surface 20 of the first portion 10. The central portion thickness t2 can be in a range of, for example, 1.2 mm to 1.8 mm. The central portion thickness t2 can be in a range of, for example, 2.0 mm to 3.0 mm. In some embodiments, the central portion thickness t2 can conform with the disc standard set forth by USA Ultimate.

In some embodiments, the first and/or second portion 10, 12 may have a concave portion 15 on the top side 14 of the flying disc 1. The concave portion 15 may be shaped to fit the user's thumb, and may provide additional gripping surface and ergonomics for throwing and catching. In some embodiments, the concave portion 15 may affect the aerodynamic properties of the flying disc 1. For example, the concave portion 15 may act as a spoiler and enhance the stability of the disc in flight, or other flight dynamics. For example, the concave portion 15 may allow the user to impart a greater maximum thrust to the disc 1 using certain throwing techniques than the disc 1 without the concave portion 15.

Figure 4:
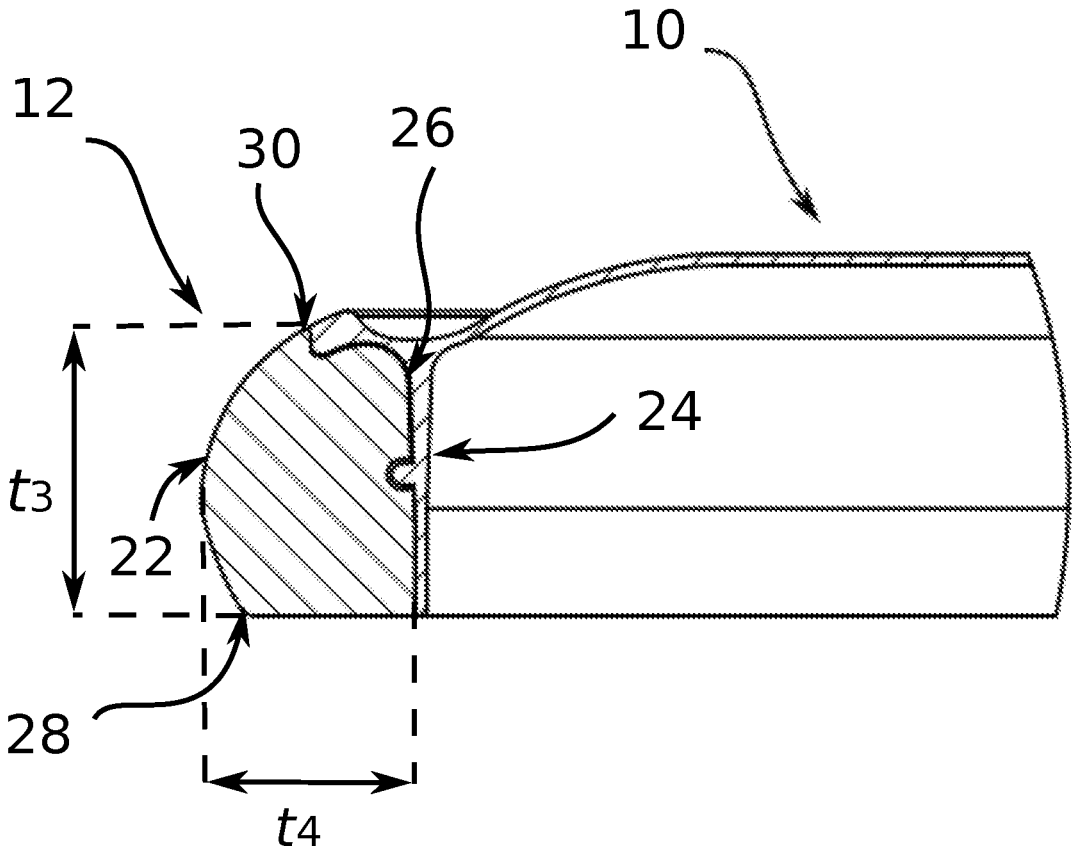
FIG. 4 is a zoomed-in view of a portion of the disc shown in FIG. 3.

FIG. 4 shows a zoomed-in view of a portion A of the disc 1 shown in FIG. 3. As illustrated in FIG. 4 the first and second portions 10, and 12, are connected by a connection seam 26. In some embodiments, the first portion 10 and the second portion 12 may be detachable. In such embodiments, the first and second portions 10,12 can be joined mechanically by way of, for example, a lip and boot attachment. The second portion 12 has an outer portion 22 and an inner portion 24. The outer portion 22 faces outward and the inner portion 24 faces inward. In some embodiments, the inner portion 24 may be shaped such that the user's finger(s) may fit to grip the disc 1. In some embodiments, the first portion 10 and/or the second portion 12 may include a bonding feature. In some embodiments, the bonding feature may comprise protrusions or branches. In some embodiments, the bonding feature may comprise holes. For example, a portion of the first portion 10 that abuts the second portion 12 can comprise a hole(s). The hole(s) may increase a bonding surface area between the first and second portions 10, 12 and/or provide a physical structure for locking or coupling the first and second portions 10, 12 together.

The second portion 12 can have two thicknesses, a vertical rim thickness t3 and a horizontal rim thickness t4. The vertical thickness t3 is measured vertically from a lower portion 28 of the second portion 12 to a upper portion 30 of the second portion 12. The vertical thickness t3 of the second portion 12 can be, for example, about 32 mm. The vertical thickness t3 of the second portion 12 can be in a range of, for example, 30 mm to 34 mm, in a range of, for example, 34 mm to 37 mm, in a range of, for example, 25 mm to 29 mm, etc. The horizontal rim thickness t4 is measured horizontally, perpendicular to the vertical rim thickness t3, from an outermost portion of the outer portion 22 to the inner portion 24. The horizontal thickness t4 of the second portion 12 can be, for example, about 22 mm. The horizontal thickness t4 of the second portion 12 can be in a range of, for example, 20 mm to 24 mm, in a range of, for example, 10 mm to 15 mm in a range of, for example, 25 mm to 30 mm, etc. The second portion 12 may have an average horizontal thickness that represents an average value of thicknesses measured horizontally. The average horizontal thickness can be about 21 mm. In some embodiments, the average horizontal thickness may be about 15 times the central portion thickness t2. For example, the average horizontal thickness may be about 10 to 20 times the central portion thickness t2.

Figure 5:
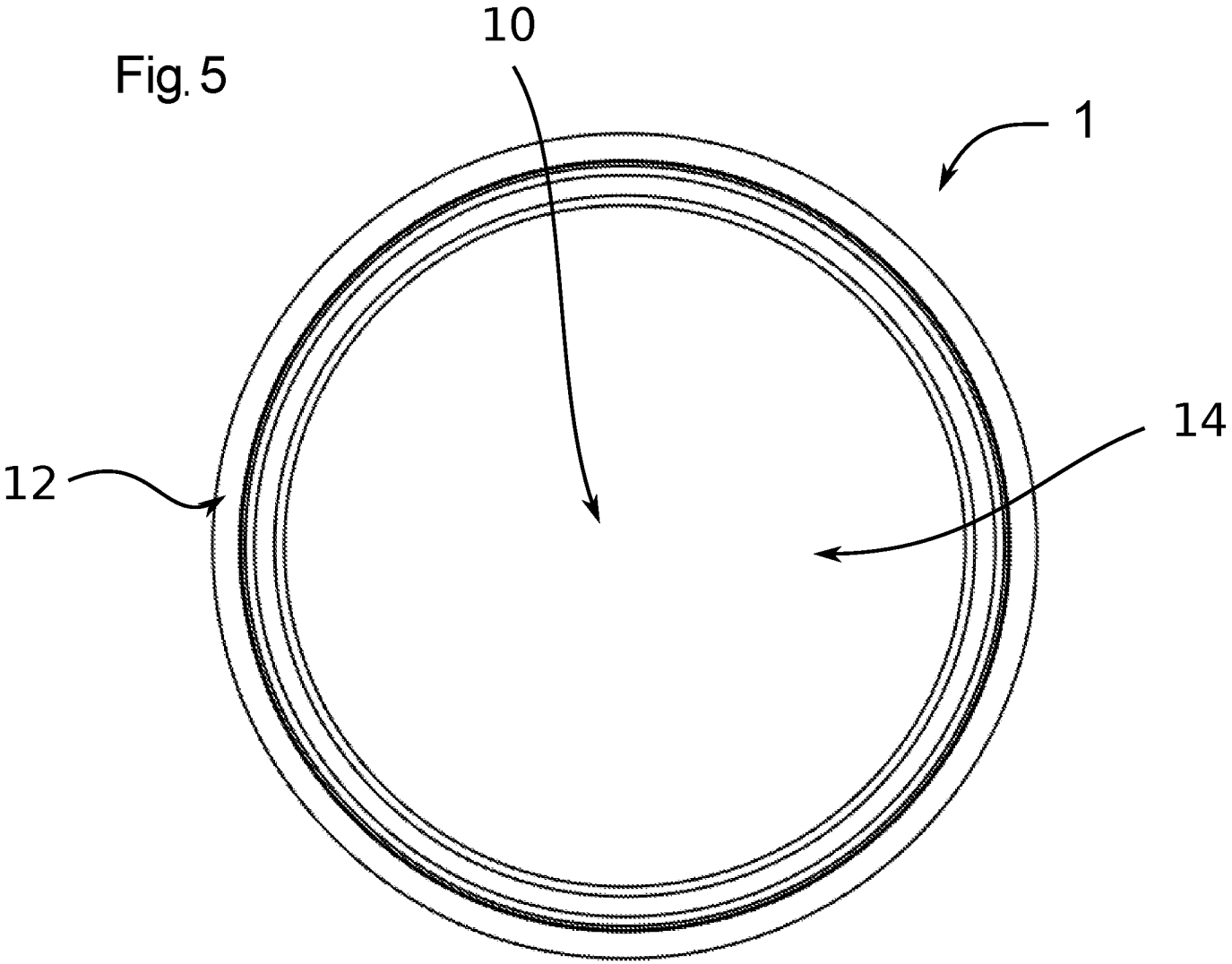
FIG. 5 is a top plan view of the flying disc of FIGS. 1-4.

FIG. 5 is a schematic top plan view of the flying disc 1 of FIGS. 1-4. As illustrated in FIG. 5, the disc 1 may have a circular shape as seen from the top. The disc 1 illustrated in FIG. 5 has the first portion 10 and the second portion 12. However, in some embodiments, the second portion 12 may be covered with the first portion 10.

Figure 6:
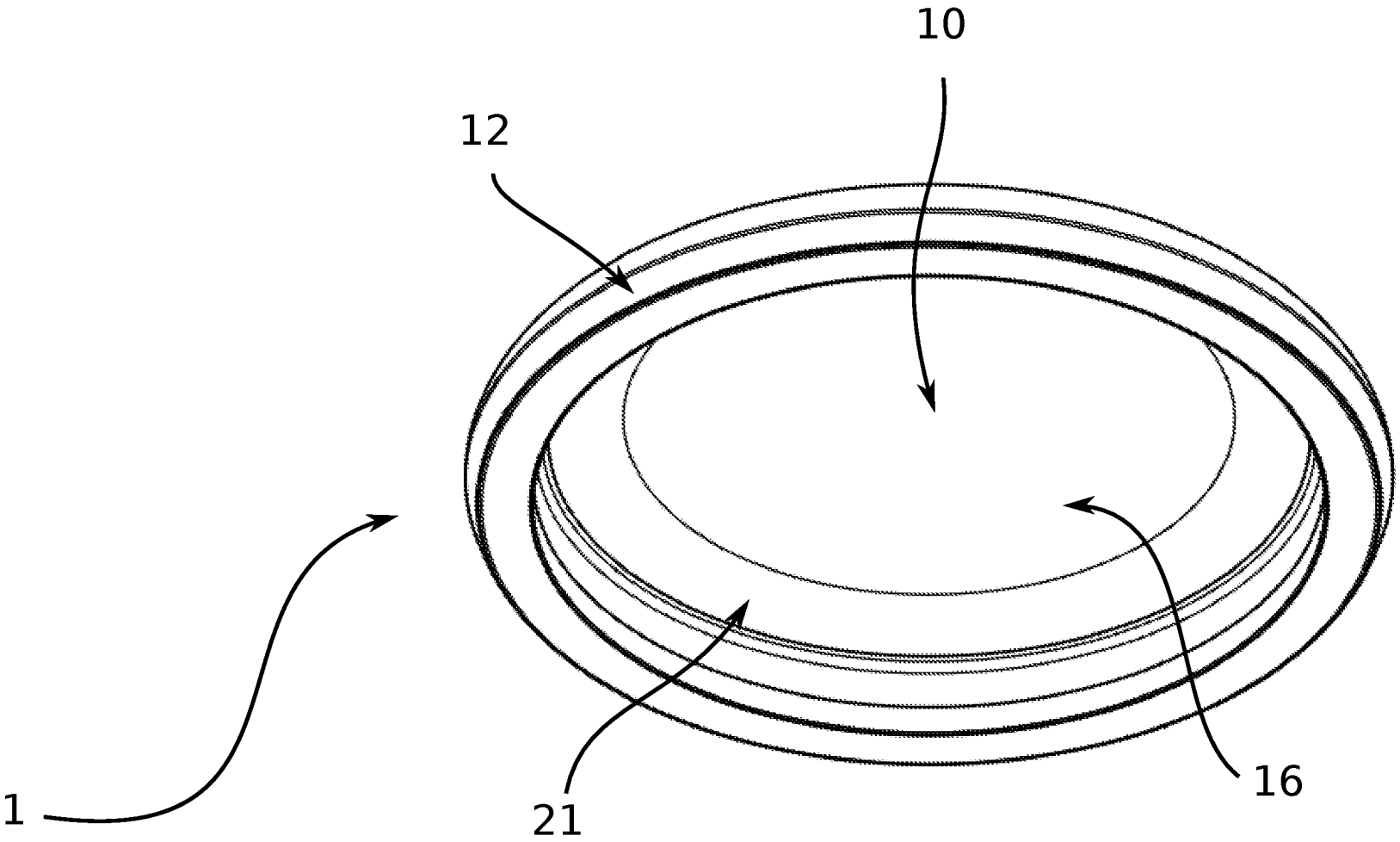
FIG. 6 is a schematic perspective view of a flying disc showing a bottom side of the disc of FIGS. 1-6.

FIG. 6 is a schematic perspective view of the flying disc 1 showing the bottom side 16 of the disc 1 of FIGS. 1-5. As illustrated in FIG. 6, the opening 21 can be defined by the inner surface of the disc 1.

Although this invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A flying disc configured to be used in Ultimate, the flying disc comprising:

a first portion comprising a first material, the first portion having a central portion which has a first thickness from a top surface to a bottom surface along an axial direction of the flying disc; and a rim portion comprising a second material, the rim portion having a second thickness from an outer edge to an inner edge along a radial direction of the flying disc, wherein the first portion has a covering portion which extends in the radial direction from the central portion and an axial portion which extends downwards in the axial direction from an intersection of the central portion and the covering portion, wherein at least a portion of the rim portion is provided between the covering portion and the axial portion such that an upper portion of the rim portion is at least partially covered by the covering portion, wherein the intersection of the central portion and the covering portion comprises an annular groove on the top surface of the first portion, and wherein the first material has a first hardness in a Shore Scale that is greater than a second hardness of the second material in the Shore Scale, and the second thickness is greater than the first thickness.

2. The flying disc of claim 1, wherein the second thickness is at least 10 times greater than the first thickness.

3. The flying disc of claim 1, wherein the first thickness is at least 1.2 mm and less than 3 mm and the second thickness is at least 12 mm and less than 35 mm.

4. The flying disc of claim 1, wherein the first material has the first hardness in a range of 40 Shore D to 100 Shore 0, and the second material has the second hardness in a range of 10 Shore A to 30 Shore A.

5. The flying disc of claim 1, wherein the first material has the first hardness of at least about 40 Shore D and the second material has the second hardness of at least about 30 Shore A.

6. The flying disc of claim 1, wherein the first and rim portions are permanently bonded during an injection molding process.

* * * * *